US005787722A

United States Patent [19]

Jenkins

[11] Patent Number: 5,787,722

[45] Date of Patent: Aug. 4, 1998

[54] HEAT EXCHANGE UNIT

[76] Inventor: Robert E. Jenkins, 2902 Hillview, Austin, Tex. 78703

[21] Appl. No.: 901,857

[22] Filed: Jul. 29, 1997

Related U.S. Application Data

[63] Continuation-in-part of Ser. No. 973,301, Nov. 9, 1992, abandoned, which is a continuation-in-part of Ser. No. 772,463, Oct. 7, 1991, abandoned.

[51] Int. Cl.[6] ..... F28D 5/00

[52] U.S. Cl. ..... 62/305; 165/162

[58] Field of Search ..... 62/305, 295, 506, 62/259.4, DIG. 16; 165/162, 163, 178

[56] References Cited

U.S. PATENT DOCUMENTS

| | | | |
|---|---|---|---|
| 2,059,839 | 11/1936 | Cesslley | 62/305 X |
| 2,644,322 | 7/1953 | Prelle et al. | 62/305 |
| 2,737,789 | 3/1956 | Ruff . | |
| 3,012,416 | 12/1961 | Dart et al. | 62/305 |
| 3,132,190 | 5/1964 | Engalitcheff | 62/305 X |
| 3,139,067 | 6/1964 | Van Den Broek . | |
| 3,212,571 | 10/1965 | Romanos . | |
| 3,290,025 | 12/1966 | Engalitcheff . | |
| 3,362,186 | 1/1968 | Patterson . | |
| 3,809,061 | 5/1974 | Gerstmann . | |
| 4,002,293 | 1/1977 | Simmons . | |
| 4,058,262 | 11/1977 | Burnham . | |
| 4,182,131 | 1/1980 | Marshall . | |
| 4,196,157 | 4/1980 | Schinner | 62/305 X |
| 4,273,733 | 6/1981 | Kals . | |
| 4,443,389 | 4/1984 | Dodds . | |
| 4,490,993 | 1/1985 | Larriva . | |
| 4,626,387 | 12/1986 | Dodds . | |
| 4,632,787 | 12/1986 | Tippmann . | |
| 4,640,460 | 2/1987 | Franklin . | |
| 4,646,820 | 3/1987 | Brightbill et al. | 165/162 X |
| 4,687,604 | 8/1987 | Goettl . | |
| 4,693,302 | 9/1987 | Dodds . | |
| 4,755,331 | 7/1988 | Merrill . | |
| 4,836,239 | 6/1989 | Kinkead . | |
| 4,842,049 | 6/1989 | Dodds . | |
| 5,046,331 | 9/1991 | O'Neal et al. | 62/305 X |
| 5,109,920 | 5/1992 | Merryfull | 165/162 X |

*Primary Examiner*—John Fox
*Attorney, Agent, or Firm*—G. Turner Moller

[57] ABSTRACT

A heat exchange unit for an air conditioning/refrigeration system includes a plurality of independent spiral coils carrying hot refrigerant. Water is sprayed onto an upper set of the coils and passes through a bank of surface media onto a lower set of coils and then into a sump where it is recirculated. Water is also sprayed onto the lower coils. Air flows upwardly though the unit and cools the downwardly moving water droplets. Although most of the cooling in the unit is from evaporation, an unusual feature is the almost complete lack of scale buildup. The unit is almost completely dark inside so algae doesn't grow. Periodic high water temperatures and periodic purging of the recirculated water minimizes fungi growth. The coils are supported in such a manner that the tubes are allowed to lengthen and expand radially when temperatures are high and shrink when temperatures are low.

20 Claims, 6 Drawing Sheets

HEAT EXCHANGE UNIT

This application is a continuation-in-part of Ser. No. 07/973,301, filed Nov. 9, 1992, which is a continuation-in-part of Ser. No. 07/772,463, filed Oct. 7, 1991, both now abandoned.

This invention relates to a heat exchange unit of the type used in a refrigeration circuit to condense a hot gaseous refrigerant into a liquid refrigerant.

BACKGROUND OF THE INVENTION

There are many different types of heat exchange units used in refrigeration systems which term is intended to include air conditioning systems. The standard smaller unit is an air cooled system in which hot gaseous refrigerant flows into a heat exchanger and a fan blows air across the heat exchanger to give up heat to the atmosphere. These systems are typically found in residences and small to medium sized buildings.

The smaller air cooled units suffer a substantial disadvantage because the greater the ambient temperature, and consequently the more capacity is required, the more difficult it is to give up heat from the hot gaseous refrigerant to the atmosphere. For example, condensing units mounted on the roof of grocery stores in the southwest have a substantial problem. When the recorded temperature at the airport in the shade is 100° F., the temperature on an asphalt-gravel roof in the sun might be 125° F. Air cooled condensing units are rated assuming the ambient temperature is 95° F. The capacity of air cooled refrigeration systems thus drops off substantially at higher temperatures for a variety of interrelated reasons, all of which have their root cause in the increasing difficulty of giving off heat to hotter air.

Air cooled condensing units also have operational and maintenance problems because of the necessarily fragile heat exchanger fins or surfaces which are exposed to the elements. Thus, standard aluminum fins lose heat transfer efficiency over time because of corrosion, fouling and deformation due to wind blown debris and the like. Conventional heat exchangers are particularly short lived in salt water environments near coast-lines. Despite all their shortcomings, it is difficult to contend that air cooled units are poorly conceived or poorly executed because they have, to date, been the standard of the industry in small capacity units.

Large units typically used for office buildings use a cooling tower in which the condensing coils are submerged in a coolant, almost always water. These large water cooled units have many advantages. They are substantially more efficient, particularly at high ambient temperatures because the cooling water is mostly cooled by evaporation and thus can be substantially cooler than ambient temperature. Water cooled units incorporating a cooling tower also have their disadvantages, many of which have to do with testing and treating the cooling water for a variety of chemicals, bacteria, fungi and algae. It is normal for water cooled units to require an individual on site during most of the operating day to oversee operations. In addition, coolant towers collect an astonishing variety and quantity of sludge in the bottom of the tower which must be periodically removed.

Another class of condensing systems for refrigeration systems incorporates one or more heat exchangers which are sprayed with a coolant, usually water. Most prior art systems have theoretical advantages because most of the cooling that occurs is due to evaporation of the sprayed water which allows condensing temperatures below ambient. Experienced refrigeration people shudder at the thought of sprayed water condensing systems because of water problems, scale buildup on the coils, algae and fungi growth and the like. It is this class of devices that this invention most nearly relates.

Disclosures of facing nozzles to produce a desired spray pattern are found in U.S. Pat. Nos. 4,002,293; 4,058,262 and 4,640,460. Disclosures of a spiral coil condenser is shown in U.S. Pat. No. 5,046,331. Of interest with respect to this invention are U.S. Pat. Nos. 3,012,416; 3,290,025; 3,362,186; 4,273,733; 4,443,389; 4,490,993; 4,626,387; 4,632,787; 4,687,604; 4,693,302; 4,755,331; 4,836,239 and 4,842,049.

SUMMARY OF THE INVENTION

The condensing unit of this invention includes a housing having a number of horizontal spiral coils onto which water is sprayed. An upward air draft through the housing cools the sprayed water by convention, conduction and evaporation. A set of upper coils is sprayed with cool water which passes through a bank of surface media acting as a heat exchanger between the downwardly moving water and the upwardly moving air. The lower coils are cooled by water dripping onto them from the surface media and by additional cool sprayed water. Water dripping into a sump at the bottom of the housing is cool enough to be recirculated. The spiral coils each have an inlet and an outlet connected to one or more different refrigeration systems so a single condensing unit can handle a plurality of different heat loads. These different heat loads may comprise different air conditioning systems or may comprise heat loads from a variety of refrigeration and air conditioning systems, as may occur in restaurants, grocery stores, florists and other specialty businesses.

One of the unusual features of this invention, not yet wholly understood, is the almost complete lack of scale buildup on the condensing coils. Several processes are believed working to prevent scale buildup. First, the coils are wet whenever the condensing unit is operating so any chemical precipitating out of the coolant water tends to be washed away. Second, the thermal coefficients of expansion of the metal coil and the ceramic precipitate are dramatically different. Thus, when the condensing unit cycles off and the coils cool down, the metal coils shrink and change shape slightly which movement cannot be duplicated or accommodated by the ceramic scale. Third, the coils actually in use are made from smooth copper tubing and lack the intricate finned heat exchange structure of conventional condensers which may come into play in some way not yet wholly understood. Fourth, it is preferred to periodically drain or flush the recirculating water and replace it with fresh water.

Several important aspects of this invention lie in the water circulation system and, more particularly, lie in features directed at accommodating debris or precipitate particles in the recirculating water. One of these features is the use of spray nozzles having spray openings large enough to pass precipitate particles and arranged to produce interfering spray patterns so the resultant droplets are small and substantially uniform. Another of these features is the provision of a sump of unusual configuration desired to collect debris or precipitate in a channel which is periodically flushed toward an outlet to discharge the debris or precipitate.

The condensing unit of this invention is located within a housing that is designed to be substantially dark inside thereby preventing sunlight from reaching the circulating water or water sump to substantially prevent algae growth inside the condenser.

In the operation of two prototypes, there has been no evidence of fungi accumulation in the recirculated water or water sump. The exact reason is not wholly understood because no fungicidal chemicals have been added to the water. Two processes are thought to be working. First, there is little or no quiescent water in the condensing unit of this invention and anecdotal observation suggests that relative quiet water accumulates fungi. On the contrary, the water spray in the condensing unit of this invention is rather vigorous and the water sump is quite small compared to the rate of water circulation. Second, periodic discharge of the coolant water in one of the prototypes has to help control fungi accumulation. This is apparently not critical because there has been no fungi accumulation in the other prototype which does not periodically flush the water sump. Third, there is some evidence that a water droplet sprayed or dripped onto the coils becomes rather hot during the short period of time it is in contact with the coil. Although fungi are known to grow in very hot water environments, such as the hot springs of Yellowstone National Park, the environment of this invention is believed to suppress fungi growth.

It is an object of this invention to provide an improved sprayed water type scale resistant heat exchange unit.

Another object of this invention is to provide a non-scaling heat exchange unit incorporating a plurality of generally horizontal, generally flat spiral heat exchange coils made of an exteriorly smooth tubing.

These and other objects of this invention will become more fully apparent as this description proceeds, reference being made to the accompanying drawing and appended claims.

DETAILED DESCRIPTION

Figure 1:
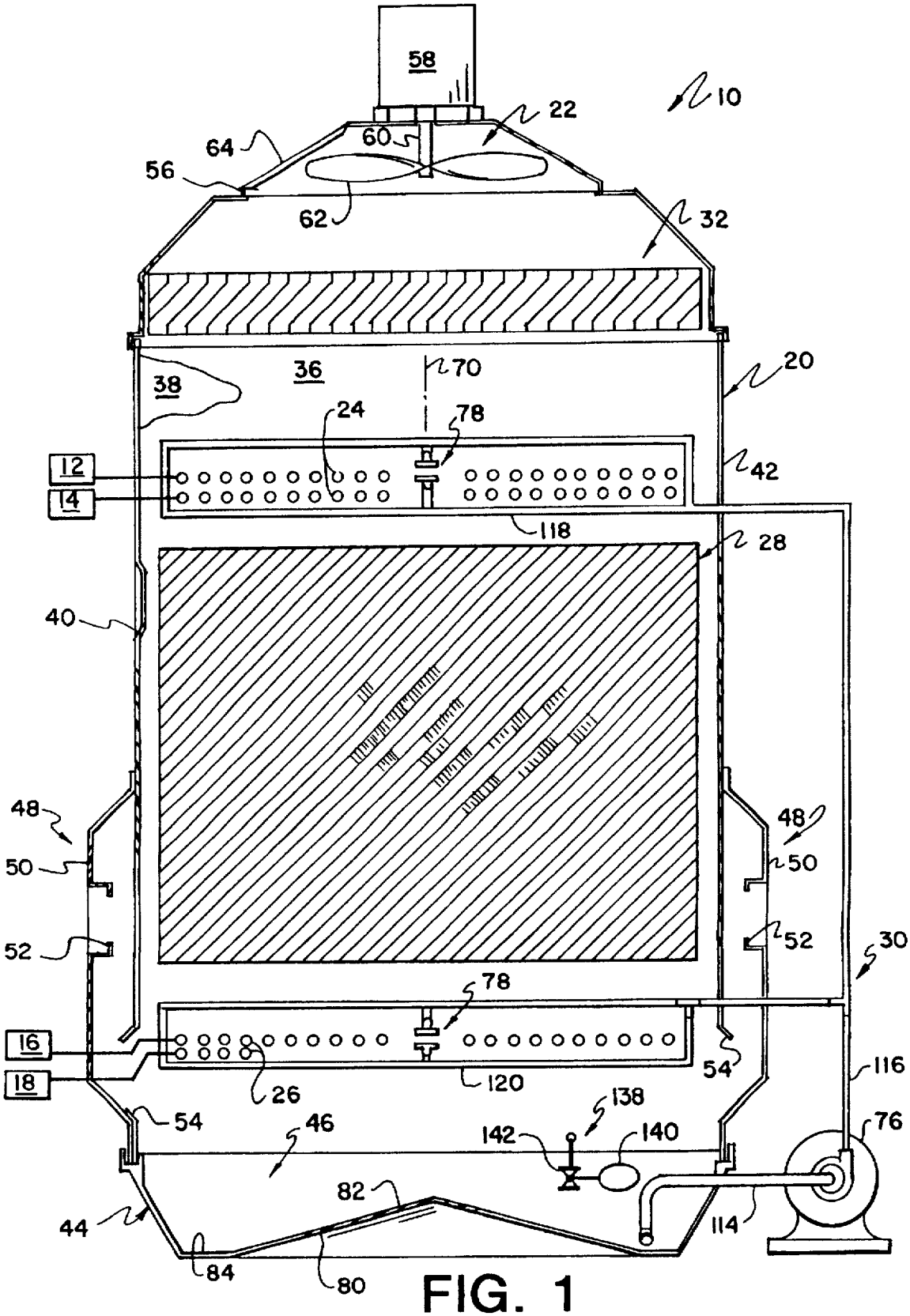
FIG. 1 is a vertical cross-sectional view of a heat exchange unit of this invention.

Referring to FIGS. 1–4, a heat exchange unit 10 of this invention is illustrated in combination with a plurality of refrigeration and/or air conditioning systems 12, 14, 16, 18. Each of the refrigeration systems 12, 14, 16, 18 circulates a refrigerant material, such as ammonia, Freon, or the like, through an evaporator, a compressor and the unit 10 of this invention.

The unit 10 of this invention comprises, as major components, a housing 20, a fan 22 for moving air upwardly through the housing 20, a plurality of upper heat exchange coils 24 and lower heat exchange coils 26 for condensing the hot gaseous refrigerant from the refrigeration systems 12, 14, 16, 18, surface media 28 between the upper and lower coils 24, 26, a water circulation system 30 and a spray or drift eliminator 32 in the housing 20.

The housing 20 provides an upwardly directed air path and a downwardly directed water spray path that are substantially shaded against direct sunlight. To these ends, the housing 20 includes a plurality of structural members or it may be of unibody type construction including a series of vertical opaque load bearing walls 36, 38, 40, 42. A bottom 44 of the housing 20 provides a sump 46 as more fully explained hereinafter. The walls 40, 42 provide an air inlet structure 48 including a panel 50 providing a first opening 52 vertically spaced from a second opening provided by the walls 40, 42. The openings 52, 54 are positioned so that sunlight from any location above the horizon cannot pass directly through the openings 52, 54 into the interior of the housing 20. On reflection, it will be seen that the opening 52 is preferably above the opening 54. If the opening 54 were uppermost, the housing 20 would have to be taller for not much purpose. Because sunlight cannot pass directly through the drift eliminator 32, the air inlet openings 52, 54 are staggered and the housing walls and bottom are opaque, the housing 20 is dark inside. This substantially prevents algae growth because algae are plants requiring sunlight to survive.

The fan 22 is mounted on top of the housing 20 above the drift eliminator 32 in any suitable fashion. Conveniently, a structure 56 supports a motor 58 having a shaft 60 driving a fan blade 62. The structure 56 includes vents or slots 64 allowing air to escape. It will accordingly be seen that the unit 10 provides a upwardly moving air stream so air passes downwardly through the inlets 52, 54 and then upwardly inside the housing 20 to escape through the slots 64.

The upper and lower coils 24, 26 are conveniently identical although they may be specifically designed for the heat loads to be carried as thus be different. The coils 24, 26 are made from a smooth exterior metal tubing, preferably copper, and are spirally wound on a jig and then brazed to one or more supports 66 to stabilize the spiral coil and dampen vibration to the extent that adjacent windings of the spiral do not touch. The supports 66 are conveniently radial. Thus, the supports 66 prevent thermal growth of the coils 24, 26 beyond the extent allowed by the length of the coil between adjacent connections to the support 66. This would seem to counteract the notion that thermal contraction and expansion of the coils 24, 26 sloughs off ceramic precipitate which, in prior art devices, adheres to analogous condensing structures. In fact, this is not the case and it appears that thermal growth in a radial direction relative to the tube axis 68, as compared to thermal growth relative to the coil axis 70, sloughs off scale. The coils 24, 26 provide a straight inlet and outlet ends 72 extending through a grommet (not shown) or other sealing structure in the wall 40 for connection to the refrigeration systems 12, 14, 16, 18. The straight inlet and outlet ends 72, 74 merge with the curved portions of the coils 24, 26 in any suitable manner.

The coils 24, 26 may be substantially flat or, in a preferred arrangement, may be slightly conical with the apex preferably down. It has been learned that, with slightly conical shapes, the supports 66 may be eliminated by simply distorting the flat wound spirals by pulling on the apex.

The spacing between adjacent wraps of the coils 24, 26 is of considerable importance. The heat transfer capacity of the coils 24, 26 is a direct function of their length so longer coils are manifestly desirable. Within a housing 20 of given cross-sectional size, one way to make a coil longer is to place the adjacent wraps of the coils closer together. There is a limiting factor because gaps of sufficient size between adjacent wraps are necessary to allow upward air flow through the coils and downward water flow. To minimize the circumference of the spiral and optimize the heat exchange capability of the coil, the size of the gap between adjacent windings should be the smallest space that will accommodate a full, free flow of air around and over the tube walls. It is believed that optimum limits for the gap between adjacent windings is in a range on the order of about 0.65–0.85 of the diameter of the tube and preferably about 0.75 of the diameter of the tube.

The surface media 28 may be of any suitable type and is sized to provide the desired amount of cooling relative to the amount of air and water circulated through the housing 20 in accordance with conventional operating techniques. Any suitable type of surface media may be employed, such as is commercially available from Brentwood Industries, Inc., Reading, Pa. under the tradename ACCU-PAK. For a more complete description of the surface media 28, reference is made to the publications of Brentwood Industries, Inc. Surface media, as used herein, provides heat exchange between upwardly moving air in the housing and downwardly moving water. Typical surface media provides inclined sheets of material spaced apart in small separate channels by dimples, corrugations or the like formed in the sheets. The material may be of any suitable type but is usually plastic.

The water circulation system 30 provides a number of desirable features of this invention. The system 30 includes, as major components, a sump 46 provided by the bottom 44 of the housing 20, a water pump 76 and a spray nozzle 78 above the upper coil 24 and another spray nozzle 78 above the lower coil 26. In the event the coils 24, 26 are slightly conical with the apex down, the spray nozzles 78 should be immediately above the apex and below the top of the coil.

Figure 3:
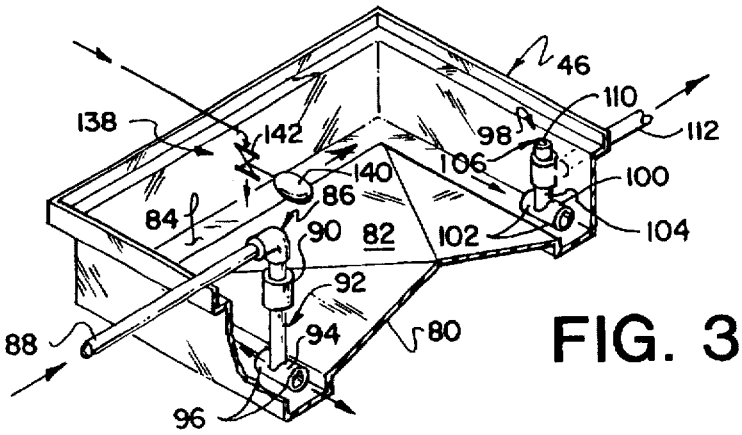
FIG. 3 is a broken isometric view of the water sump of the device of FIG. 1.
Figure 2:
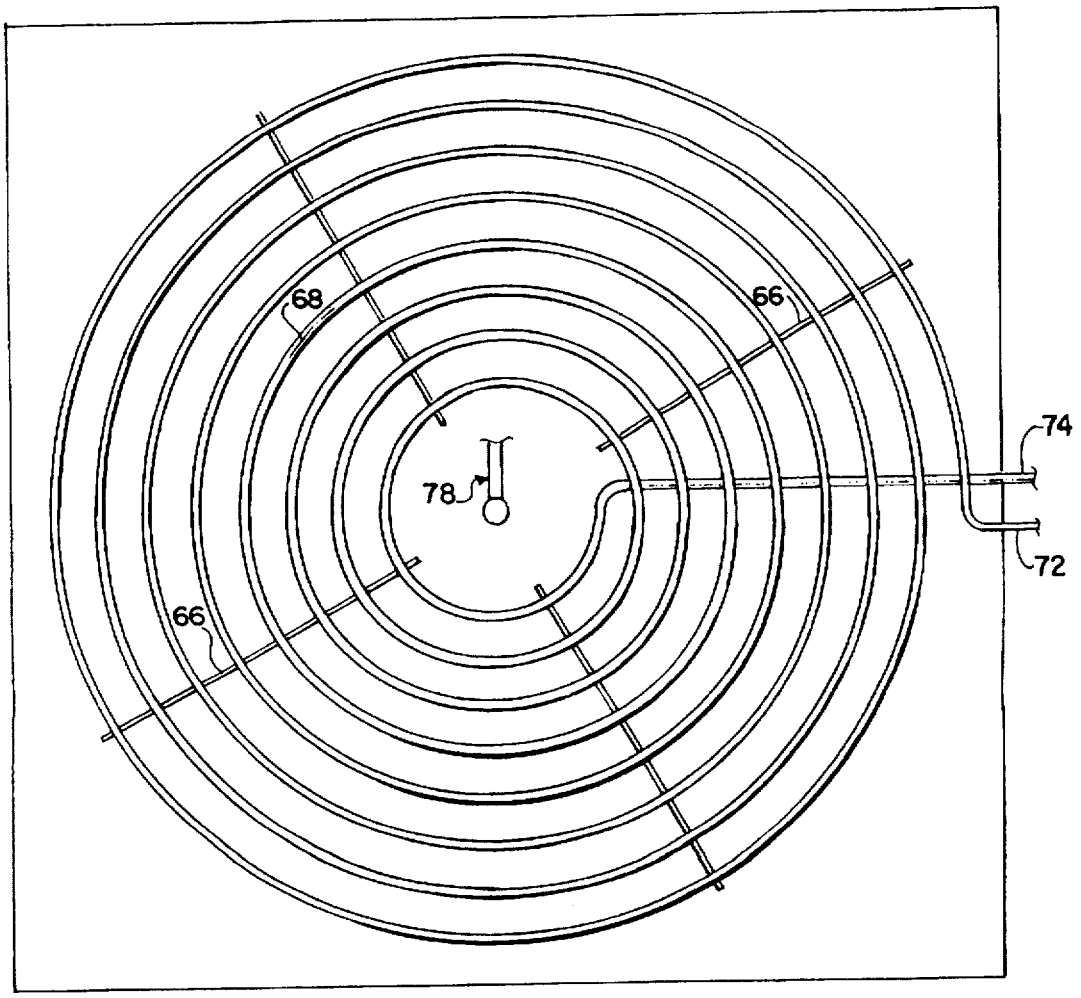
FIG. 2 is a top view of one of the heat exchange coils of FIG. 1.
Figure 4:
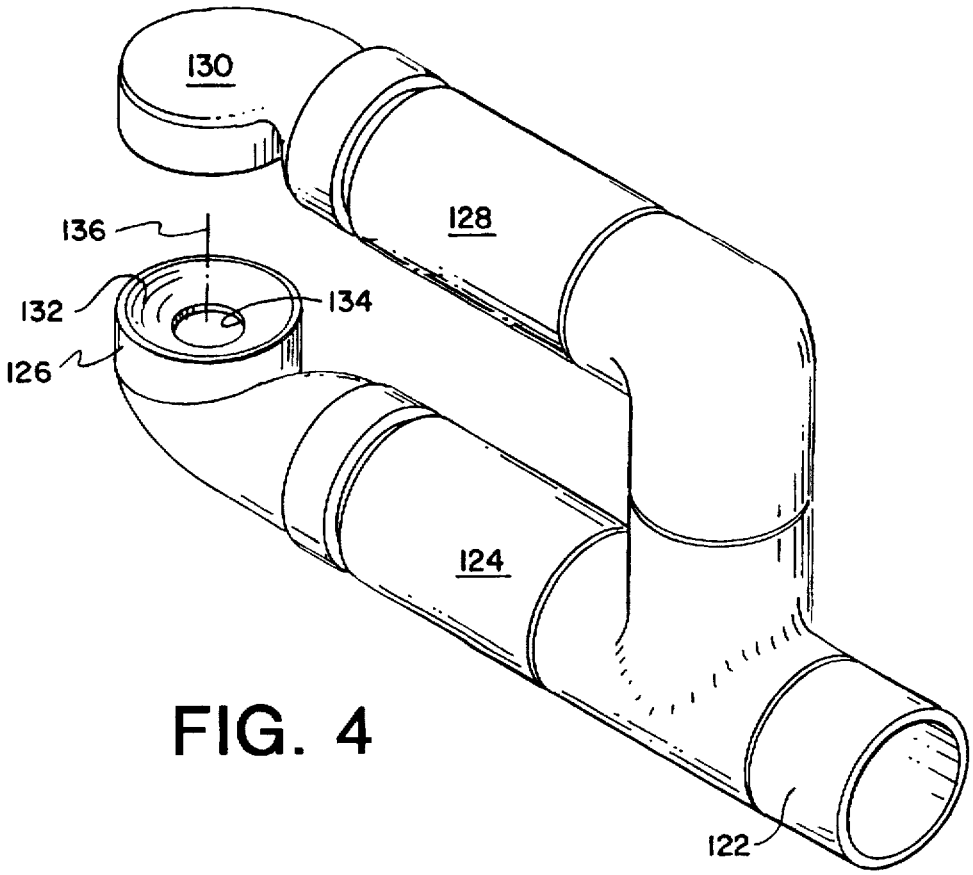
FIG. 4 is an enlarged view of the spray nozzles of this invention.

As shown in FIGS. 1 and 3, the sump 46 is of unusual design having a bottom wall 80 providing an elevated inclined central area 82 which is conveniently pyramidal in shape leaving a distinct flow channel 84 extending about the periphery of the bottom wall 80. Any solids accumulating in the sump 46 tend to gravitate into the channel 84, assisted by any vibration of the bottom wall 80 induced by operation of the fan 22, pump 76, wind or the like. A water purge system 86 includes a conduit 88 leading to a source of water, a valve 90 and a discharge structure 92 directing water flow through the channel 84. The valve 90 may be manually operable but is preferably solenoid operated and connected to an automatic timer so the frequency and duration of valve opening may be easily controlled.

The discharge structure 92 conveniently includes a tee 94 having legs 96 parallel to the channel 84 directing water flow along and parallel to the channel 84 as shown best in FIG. 3. It will be seen that purge water flows in the channel 84 toward an outlet structure 98 steadily pushing any debris in the channel 84 toward the outlet structure 98.

The outlet structure 98 includes a tee 100 having legs 102 aligned with the channel 84, an upright conduit section 104, a siphon breaker 106 comprising a tee 108 having an open upper leg 110 and an outlet conduit 112 connected to a drain line (not shown) or the like. The outlet structure 98 appears unduly complicated when compared to a simple downwardly directed conduit but it has the overwhelming advantage of not needing a valve which would have to be concurrently operated with the valve 90 and which would be subject to being plugged open or plugged shut by scale. Thus, purging the sump 46 is controlled entirely by the valve 90 and the outlet structure 98 has no moving parts subject to malfunction.

The pump 76 includes an inlet 114 extending through the housing bottom 44 into the sump 46 and an outlet 116 connected to a pair of cages 118, 120 made of tubular stock supporting the upper and lower coils 24, 26. The cages 118, 120 accordingly have two functions—support the coils 24, 26 and deliver water to the nozzles 78. In a unibody style construction of the housing, the cages 118, 120 connect to the outer walls 36, 38, 40, 42 thereby stiffening the housing 20.

As will be apparent shortly, the spray pattern of the nozzles 78 is created by directing two or more water streams toward each other to generate a spray pattern which is substantially different than would be provided by either of the streams alone. To this end, the nozzles 78 (FIG. 4) each comprise a connection 122 to one of the cages 118, 120, a first conduit 124 leading to a first nozzle head 126 and a second conduit 128 leading to a second nozzle head 130. The nozzle heads 126, 130 may be of any suitable configuration and may be of different configuration, depending on the desired spray pattern.

An important feature of the nozzle heads 126, 128 is that the spray openings are very large, so large they will not collect precipitate particles and thereby clog up. To this end, the spray openings are large. Preferably, they are of smoothly arcuate shape thereby avoiding corners or edges that might trap particles. Conveniently, the spray openings are circular although it will be seen that oval or elliptical openings are quite satisfactory.

Acceptable circular spray openings are at least 1/10 inch in diameter and preferably 3/16 inch in diameter. Acceptable oval or elliptical spray openings have a minimum dimension across the opening of at least 1/10 inch and preferably at least 3/16 inch. Prototypes of this invention have been built with circular nozzle openings between 1/8–1/2 inch in diameter and have functioned for some time without plugging due to precipitate or debris accumulation.

Desirably, the spray emitting from the nozzles 78 consists of rather fine droplets with a small size distribution. One technique providing this desirable spray is for the nozzle heads 126, 130 to provide a concave face 132 having a rather large opening 134 concentric about an axis 136. Nozzle heads of this type produce a hollow conical spray pattern because the direction of water movement through the openings 134 is not axial, it is more tangential and produces a spray pattern controlled largely by the shape of the face 132. The nozzle heads 126, 130 accordingly deliver streams of water droplets toward each other. The water droplet streams, by interference, produce a wide, relatively flat spray pattern comprising water droplets of relatively small uniform size. The efficiency of controlling water droplet size by impinging the water droplets upon each other will be recognized when one realizes that this is nature's way of producing small rain drops.

The exact spray pattern and water droplet size distribution is, of course, dependent to some extent on the water flow rate because at very low water flow rates, there is not sufficient interference between the water streams to produce the desired effect. This dependence on water flow rate occurs at only very low rates and, at the type of circulation rate needed to absorb substantial quantities of heat, the resultant water spray pattern is substantially independent of minor variations in water circulation rate. The exact spray pattern is also a function, to some extent, of the size, direction and number of the openings 134.

Water droplets generated by the nozzles 78 adjacent the upper and lower coils 24, 26 impinge and wet the hot tubing thereby heating the water, either in droplet form or in thin sheets adhering temporarily to the coils. As mentioned previously, there is some evidence that the droplets become rather hot. Excess water drips off the upper coils 24 and passes through the surface media 28 and is cooled mainly by evaporation and partially by conduction and convection with air rising in the housing 20. Cooled water from the media 28 drips onto and through the lower coil 26, mixing with water sprayed through the lower nozzle 78. At first blush, placing the lower coil 26 below the surface media 28 seems odd because one would think it desirable to allow cool water exiting the media 28 to fall into the sump 46 for recirculation. It turns out to be better, in most situations, to allow cool water from the media 28 to mix with hot water from the lower coil 26 rather than place the lower coil 26 between the upper coil 24 and the surface media 28. The reason is that the lower coils 26, above the surface media 28, would be contacted with cooled sprayed water from the nozzle 78 and hot dripping water from the upper coil 24 and thereby exposed to warmer water than the upper coil 24. There may, of course, be relatively unusual situations where it is desirable to place both the upper and lower coils 24, 26 above the media 28, as where the upper coils 24 serve a very high demand refrigeration system and the lower coils 26 serve a lower demand system.

Another component of the water circulation system 30 is a water make up system 138. In its simplest version, the water make up system 138 comprises a float 140 operating a switch (not shown) to open the solenoid valve 90 on the purge system 86. In the alternative, the float 140 may open a separate valve 142 to add water to the sump 46 in response to a predetermined low water level and close the valve 142 in response to a predetermined high water level.

The drift eliminator 32 may be of any suitable type and is sized to prevent loss of water droplets of a predetermined size given the air flow rate therethrough in accordance with conventional operating techniques. Any suitable type of drift eliminator may be employed, such as is commercially available from Brentwood Industries, Inc., Reading, Pa. under the tradename CD-20 Cellular Drift Eliminator. For a more complete description of the drift eliminator 32, reference is made to the publications of Brentwood Industries, Inc. Typical drift eliminator structure provides inclined sheets of material spaced apart in small separate channels by dimples, corrugations or the like formed in the sheets. The material may be of any suitable type but is usually plastic. One advantage of this type drift elimination is that sunlight does not pass through it, thereby avoiding algae problems.

Operation of the condenser 20 of this invention should now be apparent. Hot gaseous refrigerant is circulated through the coils 24, 26 in response to operation of the refrigeration systems 12, 14, 16, 18. In response to a load, such as sensed by a predetermined high temperature in one or more of the coils 24, 26 and/or a predetermined high pressure in one of the systems 12, 14, the fan 22 and/or the pump 76 start. Water is sprayed through the nozzles 78 to impinge on and wet the smooth tubing of the coils 24, 26. Water drips off the upper coil 24 into the media 28. The water is cooled by conduction, radiation, convection and evaporation although most of the heat loss in the condenser 10 is due to evaporation of the circulated water. In this fashion, condensing temperatures substantially below ambient are achieved.

Water drips through the media 28 onto and through the lower coil 26 as the lower coil 26 is being sprayed by the nozzle 78. Water sprayed onto the lower coil 26 as well as that dripping off the media 28 falls into the sump 46 and is recirculated. Water in the sump 46 is periodically purged by water influx through the purge system 86 and overflow through the outlet structure 98 so mineral buildup in the recirculated water is controlled. Any scale or other particulate material falling into the sump 46 collects in the channel 84 and is swept toward the outlet structure 98.

The condenser 20 of this invention is unusual in providing for multiple heat loads with sprayed water cooling the coils 24, 26 with a minimum of scale buildup, algae growth and fungi growth.

Figure 5:
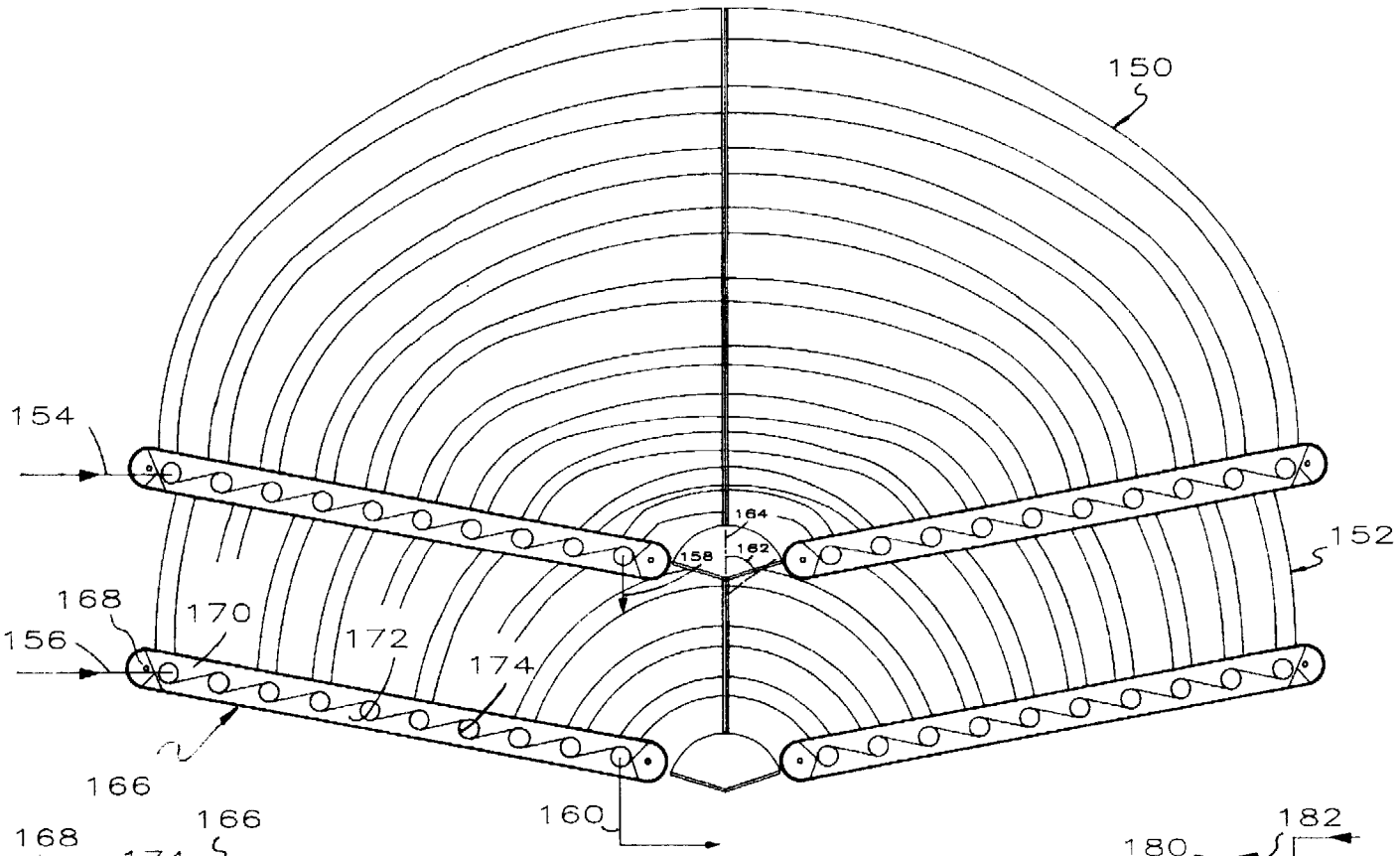
FIG. 5 is a cross-sectional view of a pair of conical spiral heat exchange coils of this invention.
Figure 6:
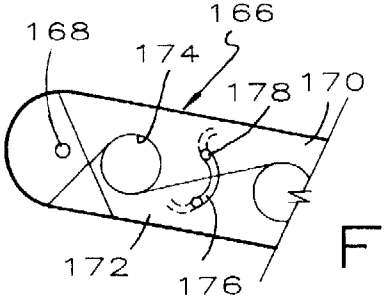
FIG. 6 is an enlarged broken view of a coil support of this invention.

Referring to FIGS. 5 and 6, another embodiment of this invention is illustrated comprising a plurality of heat exchange coils 150, 152 of conical shape, either of a single coil type or a multiple coil type. A preferred arrangement is to wind two conduits on a suitable jig in a double spiral arrangement. As will be more fully apparent hereinafter, the coils 150, 152 may be used in lieu of the coils 24, 26 of the condense 10 of FIG. 1. Conical coils are desirable for a plurality of reasons. First, it is easier to produce a spray pattern which thoroughly wets a conical coil. Second, flat coils tend to sag in the middle making them slightly conical unless they are rigidly supported. Thus, it is simpler to support a conical coil. Third, immiscible lubricating oil contained in the refrigerant does not tend to puddle up in a conical coil because it runs downhill by gravity. Thus, particularly in a manifolded system shown in FIG. 7, the refrigerant runs downhill to the refrigerant outlet so lubricant can never plug up one of the coils and the compressor will not be damaged from lack of lubricant.

The coils 150, 152 are illustrated in cross-section as sen from slightly above the base of the coil. An inlet 154, 156 connects with the largest revolution of the coils 150, 152 and an outlet 158, 160 connects with the smallest revolution. Although the coils may be of somewhat different height, their is a natural limit because otherwise the coil becomes excessively tall thereby making the condenser too tall. Thus, it is desired that a conical angle 162 between a vertical axis 164 be at least 30° and preferably at least 45° and most desirably on the order of about 60°.

In order to conserve vertical height, it is desirable to nest the coils 150, 152 as shown in FIG. 5. Because the view of FIG. 5 is from above the plane of the coil base, the coils 150, 152 appear to be crammed together somewhat more than they really are. Although it is desirable to nest the coils 150, 152 to the greatest extend possible, it is difficult to position the apex of the coil 150 much below one half the height of the coil 152 because of the need to provide a desirable spray pattern.

One feature of the conical coils of this invention is the ability to operate for long periods without undue scale buildup. A feature of the conical coils 150, 152 contributing to a lack of scale buildup is that at least a multiplicity of successive revolutions thereof are unconstrained against axial movement in a path defined by the openings in the coil supports, i.e. parallel to the axis of the tube which is the same as the spiral axis of the coil, thereby allowing the coils to expand and shrink in response to high and low operating temperatures. The coils are also unconstrained against radial movement perpendicular to the tube axis or spiral axis for at least a multiplicity of successive coil revolutions. It is clear that thermal expansion and contraction of the coil and of the tube is much greater than can be accommodated by thermal expansion and contraction of scale tending to build up on the tube. It is not presently clear whether it is axial or radial expansion of the tube which shucks scale tending to build up on its external surface.

To these ends, the coils 150, 152 are supported by a strut 166 connected by a pin (not shown) extending through an opening 168 in one end thereof to the condenser housing or other convenient location, such as a water supply conduit. The struts 166 comprise upper and lower sections 170, 172 providing, when mated together, a multiplicity of openings 174 somewhat larger than the diameter of the coils 150, 152. A keeper 176 may be threaded through small openings 178 spaced along the strut 166 to retain the upper and lower sections 170, 172 together. It will accordingly be seen that the coils 150, 152 are supported inside the condenser housing but are allow to grow axially and radially in response to high operating temperatures and then shrink in response to lower temperatures, as when the refrigeration circuit is idle.

Figure 7:
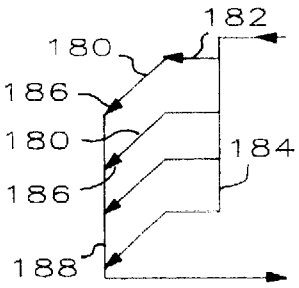
FIG. 7 is a partial schematic view of a refrigerant flow diagram.

FIG. 7 schematically illustrates a manifolded condenser arrangement where a plurality of conical coils 180 have inlets 182 connected to a manifold 184 providing warm gaseous refrigerant from a large refrigerant circuit. The outlets 186 of the coils 180 are connected to an outlet manifold 188 providing cool liquid refrigerant to the refrigerant circuit. Because every section of the coils 180 is lower than any preceding section, lubricating oil and condensed refrigerant has to run downhill to the outlets 186.

Figure 8:
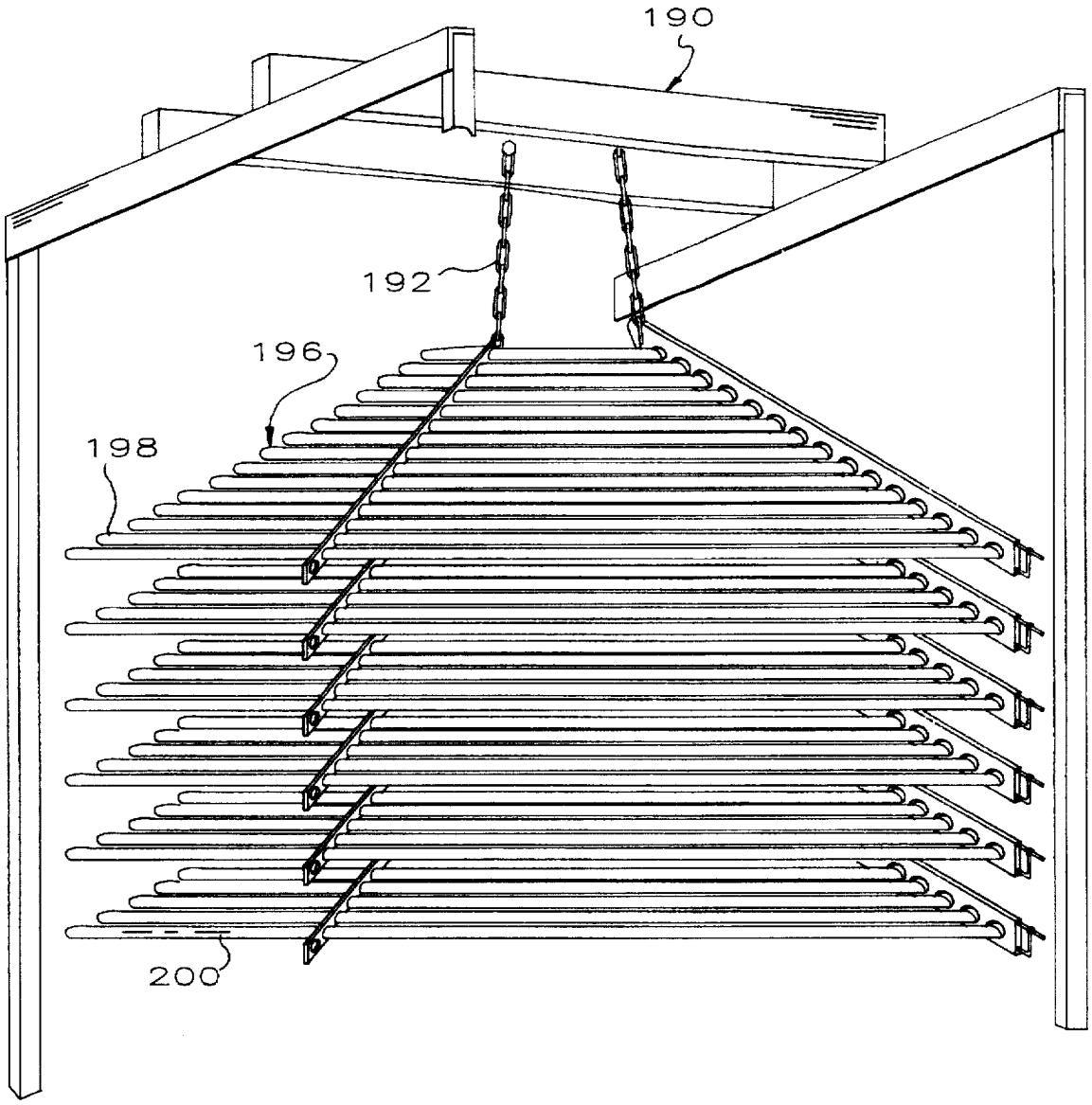
FIG. 8 is an isometric view of a series of conical spiral heat exchange coils of this invention.
Figure 9:
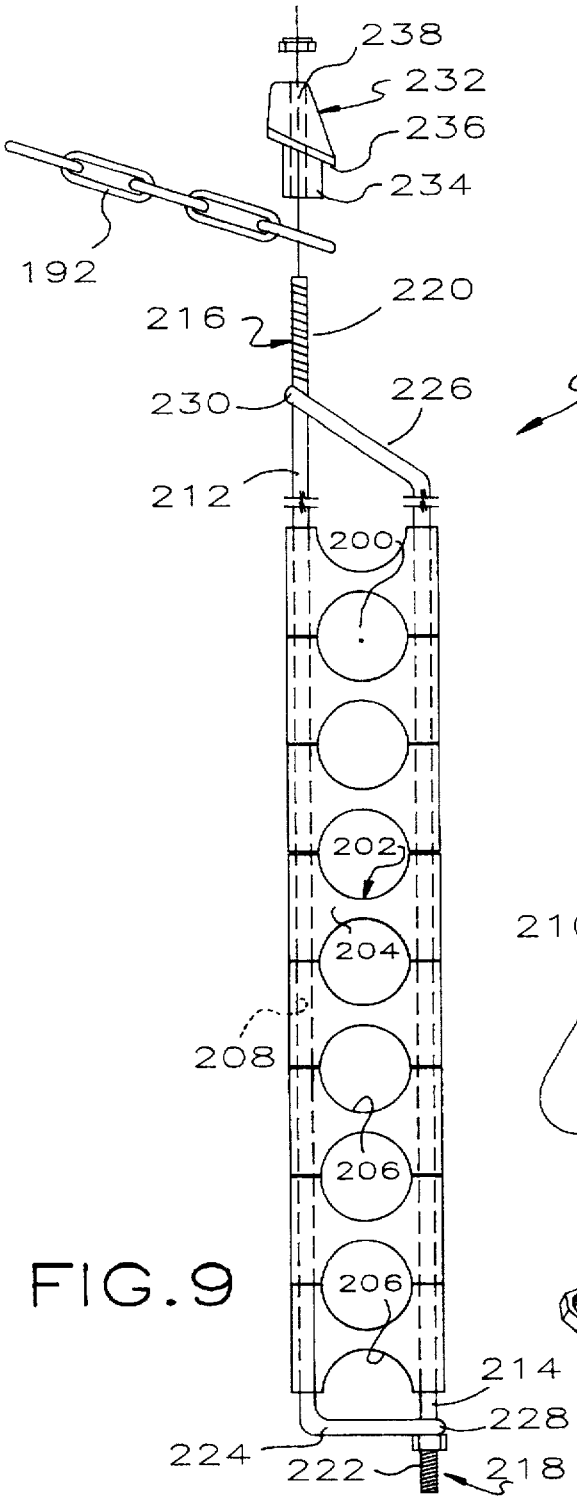
FIG. 9 is a side view of an improved coil support of this invention.
Figure 10:
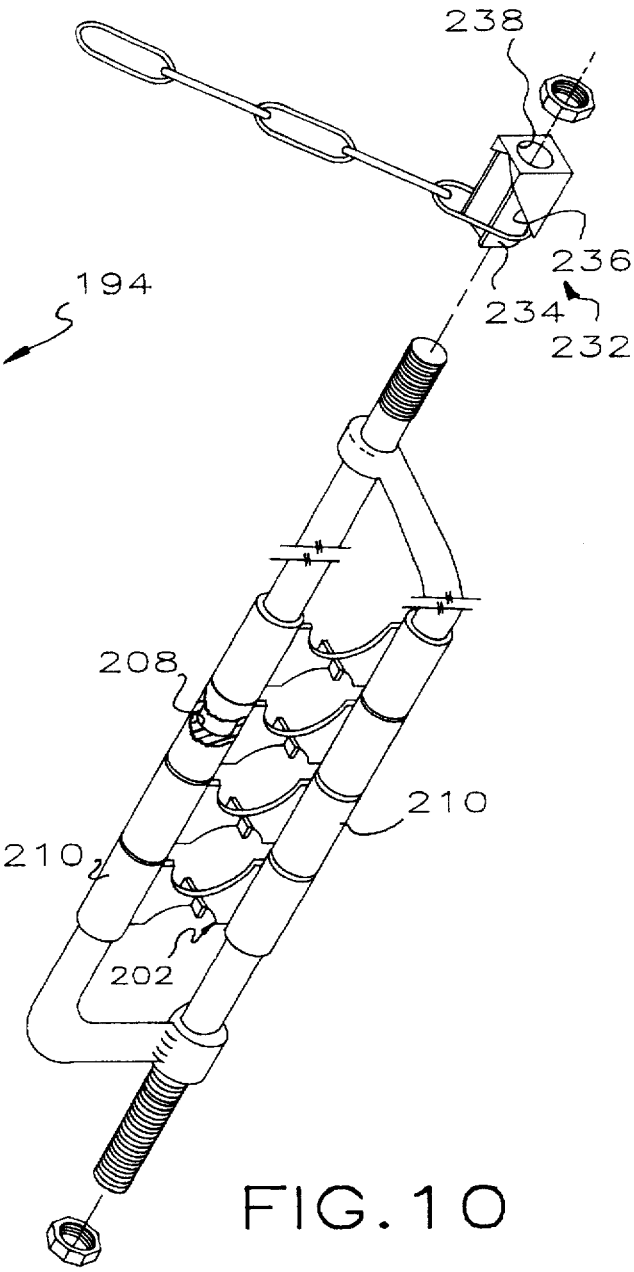
FIG. 10 is an isometric view of the coil support of FIG. 9.

FIG. 8 illustrates an improved coil support system where a metal framework 190 inside a housing (not shown) analogous to that shown in FIG. 1. One or more chains 192 or other flexible tensile supports hang from the framework 190. A series of coil supports 194 connect to the chains 192 and suspend a series of conical spiral heat exchange coils 196. As will be apparent, the coils 196 are able to move slightly due to the flexibility of the chains 192.

The coil supports 194 mount the coils 196 so the tubes 198, for at least a multiplicity of successive revolutions thereof, are unconstrained against axial movement in a path defined by the openings in the coil supports 194, i.e. parallel to the axis 200 of the tube which is the same as the spiral axis 200 of the coil 196, thereby allowing the coils to expand and shrink in response to high and low operating temperatures.

To this end, the coil supports 194 include a series of plastic injection molded mounts 202 each comprising a central web 204 providing oppositely facing semi-circular edges 206 and a pair of parallel rod receiving passages 208 on the sides of the web 204. Conveniently, the passages 208 are located in a boss 210 of greater thickness than the web 204. Individually, the mounts 202 look like a stylized I or H, depending on whether the semi-circular edges 206 are facing up and down, or sideways. It will be seen that the edges 206 provide openings through the coil support 194 of somewhat greater diameter than the tube 198 thereby allowing thermal expansion and contraction of the coil 196.

The mounts 202 are threaded onto a pair of parallel sections 212, 214 of a pair of similar rods 216, 218. The rods 216, 218 include threaded sections 220, 222 at one end and a bent section 224, 226 at the other end terminating in an eye 228, 230. The bent section 224 is substantially perpendicular to the parallel section 212 while the bent section 226 is inclined to the parallel section 214 because of the load imposed by the coils 196. It will be seen that the coil supports 194 allow thermal expansion and contraction of the coils 196, are easy to assemble and are made of relatively simple components which are easy to manufacture. In addition, the spacing and number of revolutions of the coils 196 may be accommodated by simple modification of the coil supports 194.

The coil supports 194 are hung from the chains 192 by an adapter 232 having an end 234 sufficiently small to pass through one of the chain links and a flange or shoulder 236 inclined to a passage 238 through the adapter 232. The angle of the shoulder 236 is selected so the coil supports 194 hang at an inclined angle to a vertical axis extending through the chains 192. The shoulder 236 is sufficiently large not to pass through the opening in the chain link.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A heat transfer unit comprising a housing having therein a fan creating an upward path of air movement through the housing;

a horizontal spiral heat exchange coil having a tube providing a central axis extending longitudinally of the tube and providing, in seriatim an inlet, a multiplicity of revolutions about an upright axis and an outlet for connection to a source of hot fluid;

a support mounting the coil in the housing and allowing thermal expansion and contraction of the tube, independent of the support, at least throughout a multiplicity of the revolutions;

a sump, below the coil, for collecting a coolant; and means in communication with the sump for spraying the coolant on the coil.

2. The heat transfer unit of claim 1 wherein the support allows thermal growth of the tube in the direction of the tube axis at least throughout a multiplicity of the revolutions.

3. The heat transfer unit of claim 1 wherein the support allows thermal growth of the tube transverse to the tube axis for at least a multiplicity of the revolutions.

4. The heat transfer unit of claim 1 further comprising a second horizontal spiral heat exchange coil having a tube providing a central axis extending longitudinally of the tube and providing in seriatim an inlet, a multiplicity of revolutions about an upright axis and an outlet for connection to a source of hot fluid, and a support mounting the coil in the housing and allowing thermal expansion and contraction of the coil, independent of the support, at least throughout a multiplicity of the revolutions.

5. The heat transfer unit of claim 1 wherein the coil inlet is above the coil outlet, any first segment of the coil being below any second segment upstream from the first segment.

6. The heat transfer unit of claim 1 further comprising heat exchange media below the first mentioned coil for transporting a liquid coolant downwardly through the housing in heat exchange relation with air moving upwardly in the path, the media comprising a plurality of plates providing passages therebetween; and a second horizontal spiral heat exchange coil tube providing a central axis extending longitudinally of the tube, below the media, having a second inlet and a second outlet for connection to a source of hot fluid and a series of revolutions between the inlet and outlet, at least a multiplicity of the revolutions being unconstrained against thermal expansion and contraction.

7. The heat transfer unit of claim 6 further comprising a third horizontal spiral heat exchange coil, between the first coil and the media, having a tube providing a central axis extending longitudinally of the tube, third inlet and a third outlet for connection to a source of hot fluid and a series of revolutions between the inlet and outlet, at least a multiplicity of the revolutions being unconstrained against thermal expansion and contraction.

8. The heat transfer unit of claim 7 further comprising a fourth horizontal spiral heat exchange coil, between the second coil and the media, having a tube providing a central axis extending longitudinally of the tube, a fourth inlet and a fourth outlet for connection to a source of hot fluid and a series of revolutions between the inlet and outlet, at least a multiplicity of the revolutions being unconstrained against thermal expansion and contraction.

9. The heat transfer unit of claim 1 wherein the spraying means comprises a pump having an inlet in communication with the sump and a pair of nozzles facing each other at a location adjacent the first coil for spraying the liquid coolant in intersecting paths to produce a desired spray pattern, each of the nozzles comprises a nozzle head having a central opening and a predetermined spray pattern and a vertical axis through the central opening, the axes of the openings being coaxial.

10. The heat transfer unit of claim 9 wherein the central opening is of circular shape having a minimum dimension of at least 1/10 inch.

11. The heat transfer unit of claim 10 wherein the central opening is circular.

12. The heat transfer unit of claim 1 wherein the housing includes a plurality of vertical wall members, a drift eliminator in the housing above the first coil comprising a plurality of plates providing a zig-zag upward air flow path and preventing sunlight from shining directly downwardly into the housing below the drift eliminator, the wall members providing air inlet openings and means preventing sunlight from entering the housing through the air inlet openings.

13. The heat transfer unit of claim 1 wherein the sump comprises a peripheral wall, a bottom wall providing a flow channel draining the bottom wall and a purge system including an outlet and an inlet for directing inlet water along the flow channel.

14. The heat transfer unit of claim 13 wherein the bottom wall provides an elevated area drained by the flow channel and the purge system comprises means directing inlet water along the flow channel in first and second directions around opposite sides of the elevated area.

15. The heat transfer unit of claim 14 wherein the purge system outlet comprises an upstanding conduit having a lower end in the flow channel and an upper end, a siphon breaker at the upper end of the conduit and an outlet conduit.

16. The heat transfer unit of claim 15 wherein the purge system outlet comprises means for directing flow along the flow channel.

17. The heat transfer unit of claim 16 wherein the flow directing means comprises a flow director on the lower end of the upstanding conduit, the flow director comprising a first section extending in a first direction along the flow channel and a second section extending in a second direction along the flow channel opposite to the first direction.

18. The heat transfer unit of claim 1 wherein the support comprises a member providing a series of openings therein larger than the tube, the tube extending through the openings.

19. The heat transfer unit of claim 18 wherein successive revolutions of the tube extend through successive openings in the series of openings.

20. The heat transfer unit of claim 18 wherein the coil includes an apex and a base and wherein the coil inlet is above the coil outlet, any first segment of the coil being below any second segment upstream from the first segment and the member is inclined.

* * * * *